US006512974B2

(12) United States Patent
Houston et al.

(10) Patent No.: US 6,512,974 B2
(45) Date of Patent: Jan. 28, 2003

(54) ENGINE MANAGEMENT SYSTEM

(75) Inventors: Roy D. Houston, Bethel Park, PA (US); Glen F. Chatfield, Bradfordwoods, PA (US)

(73) Assignee: Optimum Power Technology, Bridgeville, PA (US)

( * ) Notice: Subject to any disclaimer, the term of this patent is extended or adjusted under 35 U.S.C. 154(b) by 59 days.

(21) Appl. No.: 09/792,010

(22) Filed: Feb. 20, 2001

(65) Prior Publication Data

US 2002/0010541 A1 Jan. 24, 2002

Related U.S. Application Data

(60) Provisional application No. 60/183,380, filed on Feb. 18, 2000.

(51) Int. Cl.[7] ..... F02D 41/02; G06G 19/00

(52) U.S. Cl. ..... 701/115; 123/486; 307/10.1

(58) Field of Search ..... 701/1, 29, 35, 701/101, 102, 103, 104, 105, 106, 114, 115; 123/478, 480, 486, 494, 406.47, 406.64, 406.65; 307/10.1, 10.6; 434/305; 340/901, 902

(56) References Cited

U.S. PATENT DOCUMENTS

| | | | | |
|---|---|---|---|---|
| 4,322,800 | A | 3/1982 | Hisegawa et al. | 701/105 |
| 4,408,296 | A | 10/1983 | Robbi et al. | 705/400 |
| 4,496,286 | A | 1/1985 | Gagnon | 417/22 |
| 4,551,803 | A | 11/1985 | Hosaka et al. | 701/105 |
| 4,676,215 | A | 6/1987 | Blocher et al. | 123/339.19 |
| 4,677,558 | A | 6/1987 | Bohmler et al. | 701/102 |
| 4,703,430 | A | 10/1987 | Amano et al. | 701/106 |
| 4,730,256 | A | 3/1988 | Niimi et al. | 701/115 |
| 4,955,348 | A | 9/1990 | Budde et al. | 123/478 |
| 5,056,026 | A | 10/1991 | Mitchell et al. | 701/101 |
| 5,088,464 | A | 2/1992 | Meaney | 123/478 |
| 5,091,858 | A | 2/1992 | Paielli | 701/115 |
| 5,174,263 | A | 12/1992 | Meaney | 123/478 |
| 5,200,900 | A | 4/1993 | Adrain et al. | 701/115 |
| 5,268,842 | A | 12/1993 | Marston et al. | 701/105 |
| 5,269,275 | A | 12/1993 | Dahlgren | 123/492 |
| 5,284,116 | A | 2/1994 | Richeson, Jr. | 123/406.2 |
| 5,287,281 | A | 2/1994 | Meaney | 701/105 |

(List continued on next page.)

FOREIGN PATENT DOCUMENTS

| | | |
|---|---|---|
| DE | 19612796 | 10/1997 |
| EP | 0474493 | 3/1992 |
| WO | WO 9209957 | 6/1992 |

OTHER PUBLICATIONS

R. Comerford: "Pocket Computers Ignite OS Battle", IEEE Spectrum, May 1, 1998, pp. 43–46, XP002177087, the whole document.

*Primary Examiner*—Willis R. Wolfe
(74) *Attorney, Agent, or Firm*—Richard W. James; Scott Anchell

(57) ABSTRACT

An engine management system for an internal combustion engine. The engine management system comprises an engine control system calculating an engine operating control value, a palm-size computer transportable relative to the engine control system, and an external computer communicating with the palm-size computer. The engine operating control value is adapted to be supplied to the internal combustion engine to vary engine performance. The palm-size computer has height, width, and thickness dimensions that are no larger than approximately 6 inches by approximately 4 inches by approximately 1 inch. The palm-size computer runs a set of engine management tools that communicate engine management data to the engine control system. The external computer downloads to the palm-size computer engine management tools and engine management files, and uploads from the palm-size computer engine management files.

20 Claims, 5 Drawing Sheets

U.S. PATENT DOCUMENTS 5,293,317 A 3/1994 Adrain et al. ..... 701/115
5,318,449 A * 6/1994 Schoell et al. ..... 434/305
5,444,628 A 8/1995 Meaney et al. ..... 701/109
5,446,665 A 8/1995 Adrian et al. ..... 701/102
5,450,828 A 9/1995 Sakamoto et al. ..... 123/339.11
5,473,540 A * 12/1995 Schmitz ..... 701/115
5,523,948 A 6/1996 Adrain ..... 701/99
5,535,620 A 7/1996 Nichols ..... 73/118.1
5,542,393 A 8/1996 Katoh et al. ..... 123/491
5,572,978 A 11/1996 Ogawa ..... 123/491
5,582,149 A 12/1996 Kanno ..... 123/406.74
5,608,632 A 3/1997 White ..... 701/103
5,701,871 A 12/1997 Munakata et al. ..... 123/491
5,749,346 A 5/1998 Halvorson et al. ..... 123/486
5,769,051 A 6/1998 Bayron et al. ..... 123/335
5,778,857 A 7/1998 Nakamura et al. ..... 123/406.37
5,803,043 A 9/1998 Bayron et al. ..... 123/335
5,806,013 A 9/1998 Paielli ..... 701/106
5,829,410 A 11/1998 Hirose ..... 123/406.51
5,908,463 A 6/1999 Akazaki et al. ..... 701/104
5,938,716 A 8/1999 Shutty et al. ..... 701/115
6,020,654 A 2/2000 Chutorash ..... 307/10.1
6,039,012 A 3/2000 Motoyama ..... 123/65 PE
6,041,279 A 3/2000 Maki et al. ..... 701/104
6,067,965 A 5/2000 Trumpy et al. ..... 123/480
6,098,012 A 8/2000 Stander et al. ..... 701/104
6,098,591 A 8/2000 Iwata ..... 123/339.11
6,142,123 A 11/2000 Galasso et al. ..... 123/486
6,151,548 A 11/2000 Kamihira et al. ..... 701/102
6,169,943 B1 * 1/2001 Simon et al. ..... 701/115
6,170,463 B1 1/2001 Koerner ..... 123/406.2
6,175,772 B1 1/2001 Kamiya et al. ..... 700/31
6,189,057 B1 * 2/2001 Schwantz et al. ..... 307/10.6
2001/0002814 A1 * 6/2001 Suganuma et al. ..... 701/115

* cited by examiner

ENGINE MANAGEMENT SYSTEM

CROSS REFERENCE TO CO-PENDING APPLICATIONS

This application claims the benefit of the earlier filing date of U.S. Provisional Application No. 60/183,380, filed Feb. 18, 2000, the disclosure of which is incorporated by reference herein in its entirety.

FIELD OF THE INVENTION

The present disclosure is directed to an engine management system for an internal combustion engine. In particular, this disclosure is directed to providing a system that allows an operator to transfer engine management data between a palm-size computer and an engine control system, and to transfer engine management files between the palm-size computer and an external computer. As an example, a system according to one embodiment enables an operator to calibrate the engine operation, either while the engine is not running or while operating in its intended environment, by changing trim control values, which represent modifications to base engine control values that are based on an engine control map. More particularly, a recreational vehicle rider can generate trim control maps for calibrating base engine control maps, e.g., such as for ignition timing and fuel delivery, while riding or driving the vehicle.

It is believed that the performance of an internal combustion engine is dependent on a number of factors including the operating cycle (e.g., two-stroke, four-stroke, Otto, diesel, or Wankel), the number and design of combustion chambers, the selection and control of ignition and fuel delivery systems, and the ambient conditions in which the engine operates.

Examples of design choices for a combustion chamber are believed to include choosing a compression ratio and choosing the numbers of intake and exhaust valves associated with each chamber. In general, it is believed that these choices cannot be changed so as to calibrate engine operation after the engine has been built.

With regard to ignition systems, breaker point systems and electronic ignition systems are known. It is believed that these known systems provide spark timing based on an operating characteristic of the engine, e.g., speed of rotation and load. In the case of breaker point systems, it is believed that engine speed is frequently detected mechanically using centrifugally displaced weights, and that intake manifold vacuum is commonly used to detect engine load. In the case of electronic ignition systems, it is believed that engine speed is generally detected with an angular motion sensor associated with rotation of the crankshaft, and that engine load is frequently detected, for example, by the output of a throttle position sensor. In each case, spark timing is believed to be fixed according to these known systems for a given operating state of the engine.

With regard to fuel delivery systems, carburetors and fuel injection systems are known. It is believed that these known systems supply a quantity of fuel, e.g., gasoline, that is based on the amount of air being admitted to the engine, i.e., in accordance with the position of the throttle as set by the operator. In the case of carburetors, it is believed that fuel is delivered by a system of orifices, known as "jets." As examples of carburetor operation, it is believed that an idle jet may supply fuel downstream of the throttle valve at engine idling speeds, and that fuel delivery may be boosted by an accelerator pump to facilitate rapid increases in engine speed. It is believed that most carburetors must be disassembled and different size jets or pumps installed to modify the amount of fuel delivery. However, this is a laborious process that, it is believed, that most often, can only be done while the engine is not running.

It is believed that known fuel injection systems, which can be operated electronically, spray a precisely metered amount of fuel into the intake system or directly into the combustion cylinder. The fuel quantity is believed to be determined by a controller based on the state of the engine and a data table known as a "map" or "look-up table." It is believed that the map includes a collection of possible values or "setpoints" for each of at least one independent variable (i.e., a characteristic of the state of the engine), which can be measured by a sensor connected to the controller, and a collection of corresponding control values, for a dependent variable control function, e.g., fuel quantity.

Conventionally, it is believed that maps are developed by the engine manufacturer and permanently set in an engine control unit at the factory. Currently, for on-road vehicles, this is believed to be legally required in order to meet emissions regulations. However, it is believed that even when it is not legally required, the manufacturers prevent engine operators from modifying the maps for a variety of reasons such as the manufacturers believe that their maps provide the best engine performance, the manufacturers are afraid that an engine operator might damage the engine by specifying inappropriate control values, or the manufacturers assume that an engine operator might not have sufficient skill to properly modify a map. However, it is believed that the manufacturers have "optimized" their maps to perform best under a set of conditions that they specify. In most cases, it is believed that these conditions do not match the conditions in which the engine is operated. Consequently, stock maps are believed to limit, rather than optimize, an engine's performance.

It is further believed that ambient conditions such as air temperature, altitude, and barometric pressure affect engine performance. It is believed that these conditions generally impact the entire operating range of the engine. In the case of fuel injection, it is believed to be known to compensation for these conditions by calculating an adjustment for every operating state of the engine.

Thus, engine performance is believed to be substantially dependent on how combustion is accomplished in the ambient conditions. The stoichiometric ratio of air to gasoline is 14.7:1. However, it is believed that ratios from about 10:1 to about 20:1 will combust, and that it is often desirable to adjust the air-fuel ratio to achieve specific engine performance (e.g., a certain level of power output, better fuel economy, or reduced emissions). Similarly, it is also believed to be desirable to adjust ignition timing, commonly measured in degrees of crank rotation before a piston reaches top-dead-center of the compression stroke, to achieve specific engine performance (e.g., lowest fuel consumption or reduced emissions).

It is believed to be a disadvantage of known ignition timing systems and fuel delivery systems that engine operation is constrained by the fixed controls established by the suppliers of these systems. It is also believed to be a disadvantage that any possible adjustments to these known systems requires a technician to reconfigure one or more of the system components, or to disassemble the system, install substitute components, and reassemble the system. Therefore, it is further believed to be a disadvantage of these known systems that neither the effectiveness nor the sufficiency of these adjustments can be determined while continuously operating the engine in its intended environment. And it is yet further believed to be a disadvantage of these known systems that the effect of these adjustments cannot be directly compared.

There is believed to be a need to overcome these disadvantages of known ignition and fuel delivery systems.

SUMMARY OF THE INVENTION

The present invention provides an engine management system for an internal combustion engine. The engine management system comprises an engine control system calculating an engine operating control value, a palm-size computer transportable relative to the engine control system, and an external computer communicating with the palm-size computer. The engine operating control value is adapted to be supplied to the internal combustion engine to vary engine performance. The palm-size computer has height, width, and thickness dimensions that are no larger than approximately 6 inches by approximately 4 inches by approximately 1 inch. The palm-size computer runs a set of engine management tools that communicate engine management data to the engine control system. The external computer downloads to the palm-size computer engine management tools and engine management files, and uploads from the palm-size computer engine management files.

BRIEF DESCRIPTION OF THE DRAWINGS

The accompanying drawings, which are incorporated herein and constitute part of this specification, include one or more embodiments of the invention, and together with a general description given above and a detailed description given below, serve to disclose principles of the invention in accordance with a best mode contemplated for carrying out the invention.

DETAILED DESCRIPTION OF THE INVENTION

As they are used in connection with the present invention, the expressions "trim" or "trimming," "group," "map trim definition," and "map set" have specific meanings. The expressions "trim" and "trimming" refer to changing the value of one or more setpoints. The value of this change, which can be positive or negative, can be a function of the original setpoint or a selected increment. The expression "group" refers to an aggregation or parcel of setpoints that are acted upon in unison by a trimming action. A group can be defined by a "map trim definition." For example, a map trim definition can parcel out an engine control map so as to create a group of setpoints that lie within a selected range(s) of the independent variable(s), e.g., sensed engine operating characteristics. The expression "map set" refers to a single engine control map or to an association of plural related engine control maps. For example, a map set can consist solely of an ignition timing map. Alternatively, a map set can comprise an ignition timing map and a fuel delivery map.

Figure 1:
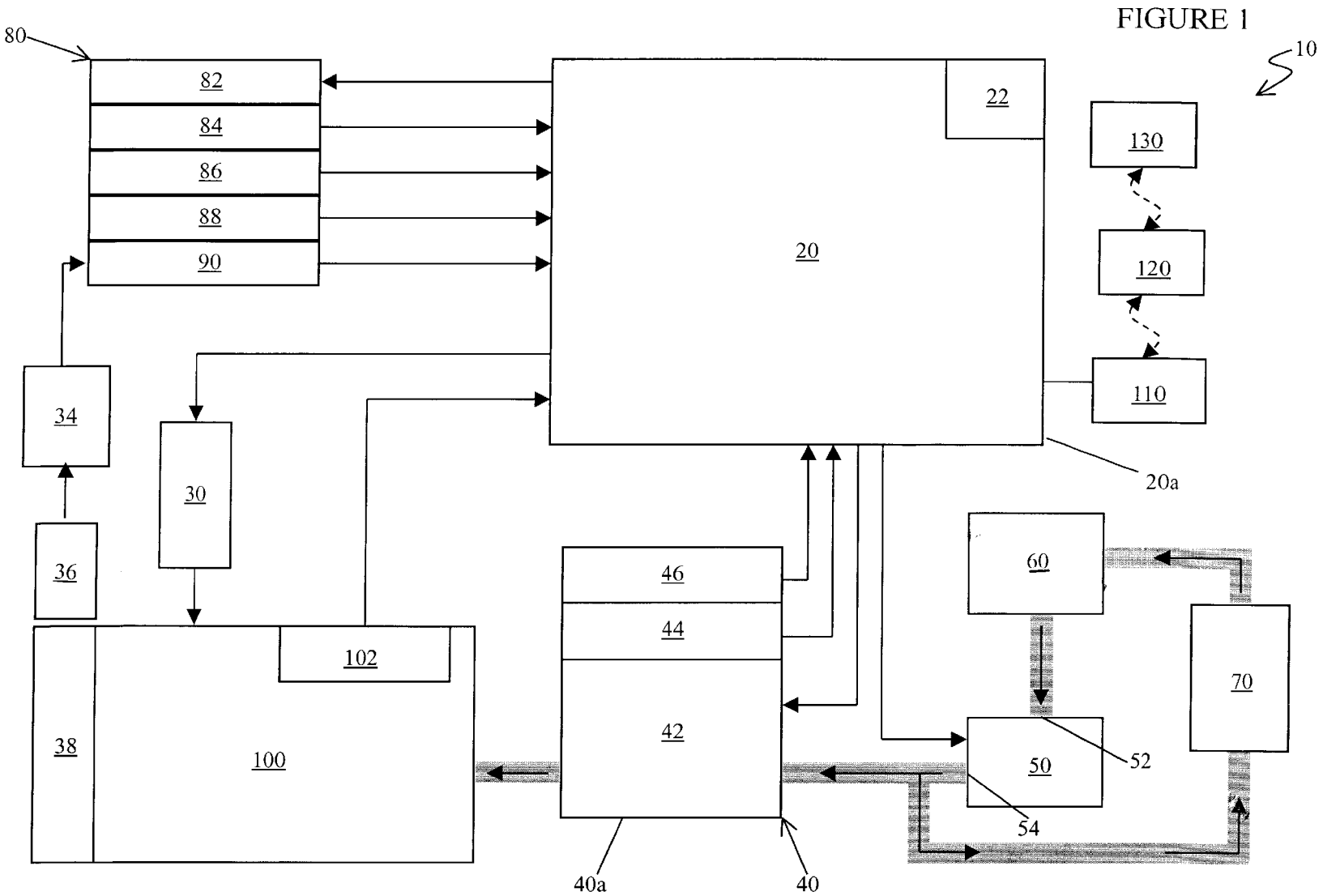
FIG. 1 is a schematic illustration of an embodiment of a system for calibrating engine operation.

Referring to FIG. 1, an engine management system 10 includes a library of engine management files in an external computer 130. These engine management files can be made available to an engine control system via a palm-size computer 120, and can be used for calibrating engine performance. The engine management 10 includes an engine control unit 20 that is coupled (e.g., via wires or wirelessly) to one or more input or output devices (e.g., sensors or actuators). The engine control unit 20 can include a processor that uses coded instructions to act on electrical input signal(s) and to supply electrical output signal(s). According to one embodiment, wires electrically connect the engine control unit 20 with various other components, which will be described in detail below. The housing 20*a* of the engine control unit 20 and the other components can be electrically grounded with respect to a vehicle chassis (not shown), e.g., a motorcycle frame, in a known manner. The electrical connections with respect to the engine control unit 20 can comprise two female sockets (not shown) mounted on the housing 20*a* for receiving corresponding right-angle male plugs (not shown) at ends of a wiring loom (not shown). Of course, any number of male plugs and any number of female sockets, in any combination and configuration, may be associated with either the housing 20*a* or the wiring loom.

The engine control unit 20 can be installed beneath an operator's seat (not shown). The engine control unit 20 can be pivotally mounted to facilitate accessibility to the electrical connections and to an ignition coil 30 that can be mounted on the underside of the engine control unit 20. Pivoting the engine control unit also facilitates draining contaminates from a barometric pressure sensor 22 that can be incorporated within the housing 20*a* of the engine control unit 20. The functions of the ignition coil 30 and the barometric pressure sensor 22, and their relationship to the engine control unit 20, will be described below in greater detail. Additionally, either or both of the ignition coil 30 and the barometric pressure sensor 22 can be mounted apart from the engine control unit 20.

According to one embodiment, the engine control unit 20 can provide a single engine operating control value, i.e., for adjusting a single engine control, such as ignition timing. However, according to another embodiment, which is shown in the figures, the engine control unit 20 can provide a plurality of engine operating control values, i.e., for controlling a plurality of engine controls, such as fuel quantity and ignition timing.

The engine control unit 20 is electrically connected to a fuel delivery module 40. The fuel delivery module 40 can include at least one fuel injector 42 that can be mounted on a throttle body 40*a* extending from a fluid inlet (not shown) to a fluid outlet (not shown). A butterfly valve (not shown) is positioned in the throttle body 40*a* between the inlet and the outlet, and is pivotal about an axis (not shown) between a first configuration preventing fluid flow through the throttle body 40*a* and a second configuration permitting fluid flow through the throttle body 40*a*. An actuator cam (not shown) is connected to the butterfly valve for pivoting the butterfly valve, against the bias of a return spring, e.g., a torsion spring (not shown), from the first configuration to the second configuration. The actuator cam can be connected, via a throttle cable (not shown), to a throttle control element (not shown), which can be operator controlled. As will be discussed in greater detail below, a throttle position sensor 44 is also connected to the butterfly valve for measuring the angular position of the butterfly valve as it is pivoted about the axis.

The fuel injector(s) 42 can be oriented so as to spray a precisely metered amount of fuel from inside the throttle body 40*a* toward an intake port (not shown) in a two-stroke engine or through a poppet valve opening (not shown) in a four-stroke engine. In the case of four-stroke engine designs having a plurality of intake valves (not shown), each of the injectors 42 can be oriented so as to spray fuel through a respective valve opening.

The fuel delivery module 40 may further comprise an intake air-temperature sensor 46 that can be, for example, mounted through the wall of the throttle body 40*a*, and upstream from the butterfly valve. The functions of the air-temperature sensor 46 and its relationship to the engine control unit 20, will be described below in greater detail.

The fuel delivery module 40, in cooperation with the engine control unit 20, provides a number of advantages including the ability to be adjusted electronically without being removed, disassembled, reassembled, and reinstalled. Another advantage is the ability to be electronically adjusted while the engine is running. Another advantage is the ability to provide separate control of different groups of setpoints that are specified by map trim definitions, which will be described below in greater detail. Yet another advantage is that the fuel injector(s) 42 can be programmed to compensate for changes in ambient conditions, e.g., changes in barometric pressure or air-temperature. According to embodiments of the engine management system 10, it is possible to compensate for variations in the voltage available to actuate the fuel injector(s) 42, and with a lambda sensor, to also compensate for wear and aging of the fuel injector(s) 42.

An electrically operated fuel pump 50 having a low pressure fuel inlet 52 receiving fuel from a fuel tank 60 and a high-pressure fuel outlet 54 can deliver pressurized fuel to the fuel injector(s) 42. The fuel pump 50, which can be electrically interconnected with the engine control unit 20, can be a positive displacement type pump or a dynamic type pump. A pressure regulator 70 can be connected to the high-pressure fuel outlet 54 for regulating the pressure of the fuel supplied to the fuel injector(s) 42. The pressure regulator 70 can relieve excess pressure by returning a portion of the high-pressure fuel stream to the fuel tank 60. The fuel pump 50 can be mounted wherever space permits, e.g., on the exterior of an engine 100.

A fuel filter (not shown), which can be serviceable, can be a separate unit located at any position along the fuel supply, or the fuel filter can be incorporated within the fuel tank 60, fuel pump 50, fuel injector(s) 42, or pressure regulator 70.

Figure 2:
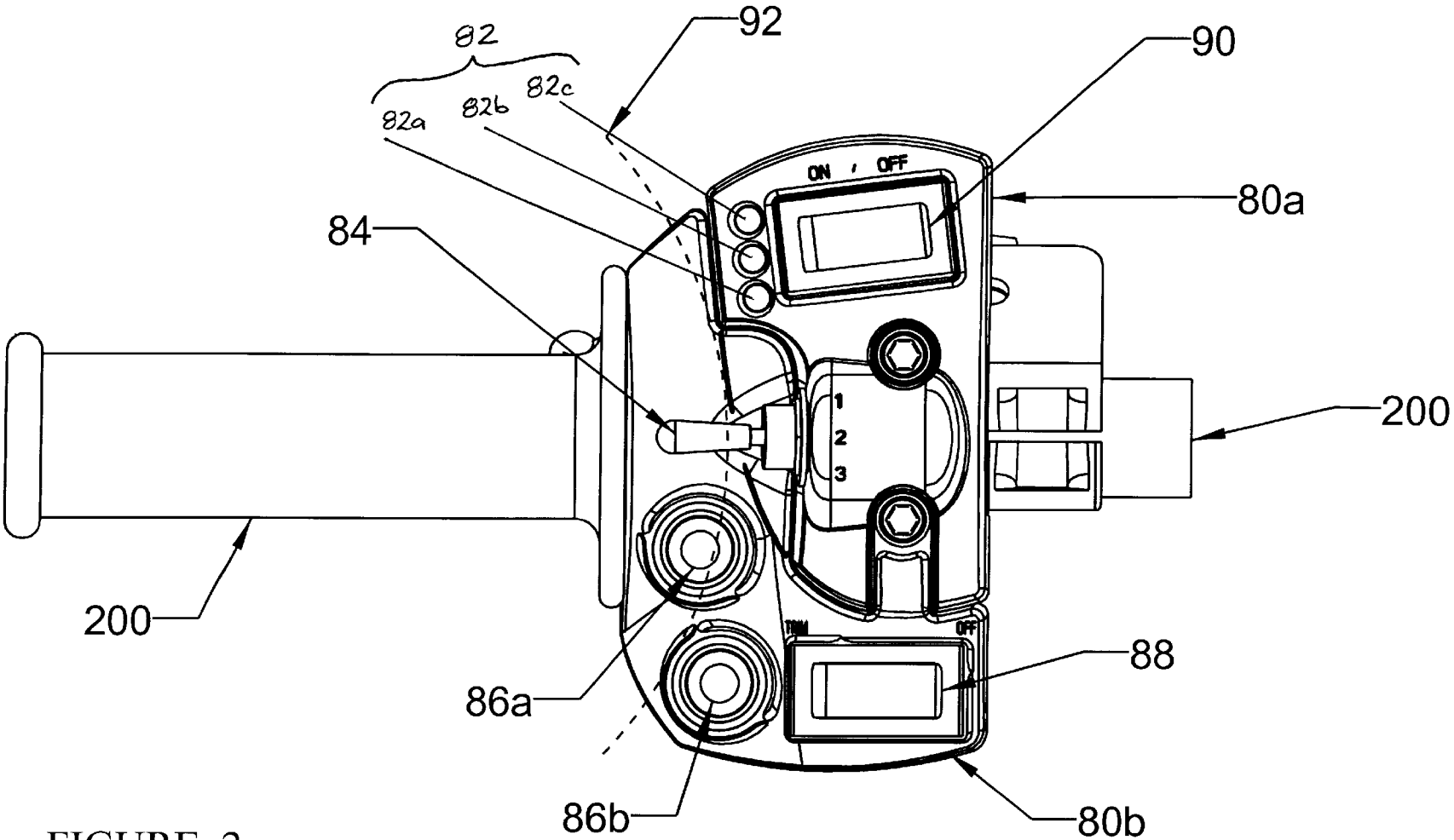
FIG. 2 is a plan view of a dash panel according to a first embodiment.
Figure 3:
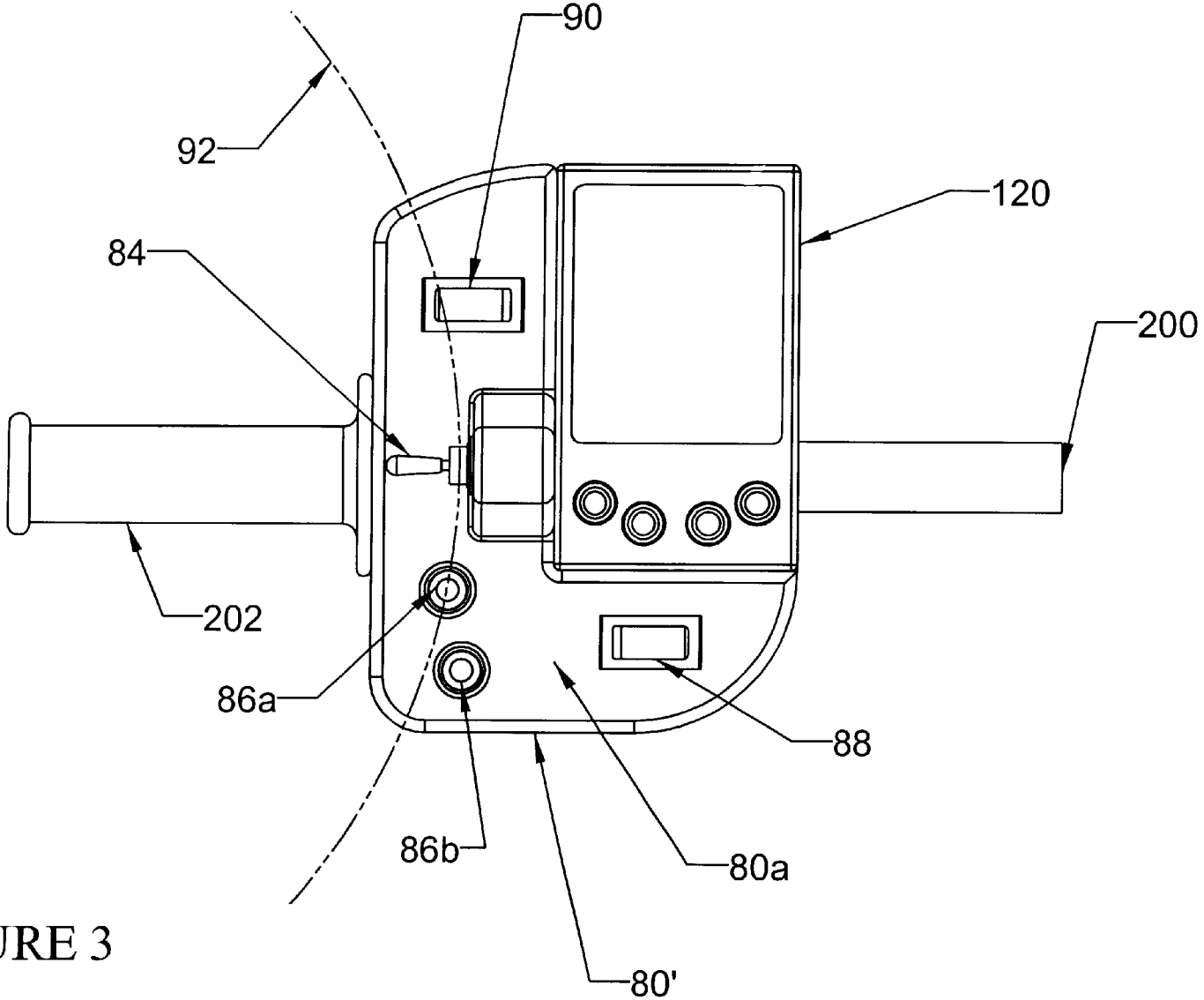
FIG. 3 is a plan view of a dash panel with a docked palm-size computer according to a second embodiment.
Figure 4:
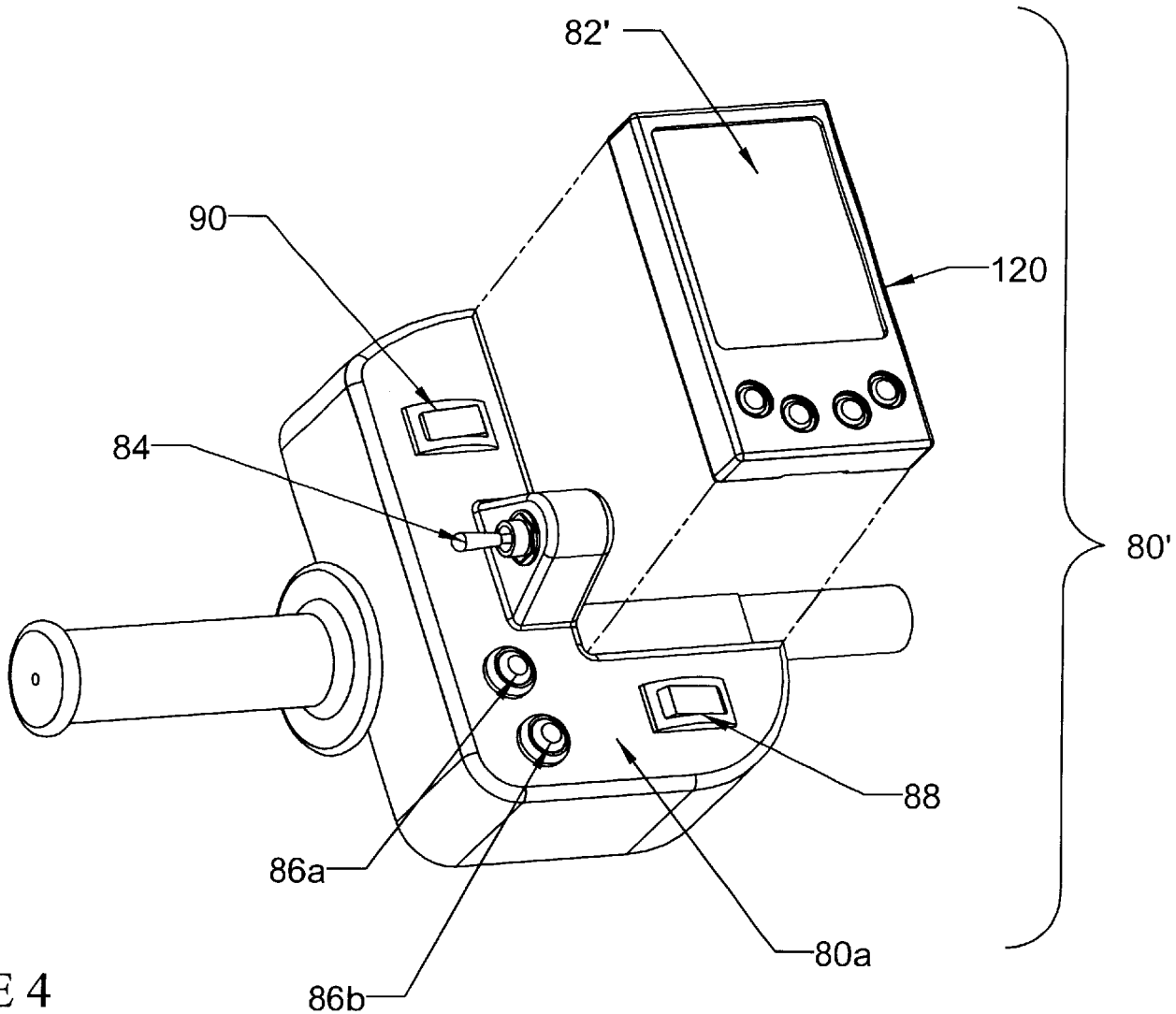
FIG. 4 is a perspective view of the dash panel shown in FIG. 3 with the palm-size computer shown in a detached configuration.

Referring additionally to FIGS. 2–4, the engine control unit 20 is electrically connected to a dash panel 80 that is readily accessible to an operator, e.g., the rider in the case of a motorcycle. The dash panel 80 can comprise at least one switch for regulating a trim signal supplied to the engine control unit 20 and can comprise at least one display device 82 for conveying to the operator information supplied from the engine control unit 20. As shown in FIGS. 2–4, the dash panel 80 can include a map set selection switch 84, at least one trim +/– adjustment switch 86 (e.g., a trim + pushbutton 86*a* and a separate trim – pushbutton 86*b* are shown in FIGS. 2–4), a trim defeat switch 88, and an on/off switch 90. The trim defeat switch 88 regulates a trim defeat signal that causes the engine control unit 20 to perform two functions. In an "on" position of the trim defeat switch 88, the engine control unit 20 calculates the engine operating control values equal to the base engine control values as modified by trim control values, and the engine control unit 20 processes the trim signals (as regulated by the at least one trim +/– adjustment switch 86) and the trim defeat signals (as regulated by the trim defeat switch 88). In the "off" position of the trim defeat switch 88, the engine control unit 20 calculates the engine operating control values equal to only the base engine control, and the engine control unit 20 ignores the trim signals (as regulated by the at least one trim +/– adjustment switch 86) and the trim defeat signals (as regulated by the trim defeat switch 88). The on/off switch 90 activates or deactivates electricity to all of the components of the apparatus 10 For example, the on/off switch 90 can disconnect the battery 34 and the alternator (i.e., stator 36 and rotor 38) from the engine control unit 20. The display device 82 can be any analogue or digital device, and can display alpha-numeric characters or graphical images. As shown in FIG. 2, the display device 82 can include three "smart" lights 82*a*,82*b*,82*c*. The functions of the switches 84,86,88,90 and display device 82 on the dash panel 80, as well as their relationship to the engine control unit 20, will be described below in greater detail.

The dash panel 80 is mounted with respect to the operator for ergonomic actuation of the switches 84,86,88,90 and ready visibility of the display device 82. For example, in the case of a motorcycle, the dash panel 80 can be mounted on the handle-bars 200, e.g., proximate to the left-hand grip 202. Of course, the dash panel 80 could be located at other positions that are readily accessible/visible to the rider in the course of operating the motorcycle. By locating the dash panel 80 as shown in FIGS. 2–4, the switches 84,86,88,90 can be ergonomically arranged so as to facilitate tactile identification and operation of the switches 84,86,88,90 using the rider's left thumb. Broken line 92 indicates a possible line of travel of the rider's thumb. Moreover, the smart lights 82*a*,82*b*,82*c* are presented to the rider such that even a quick glance can enable the rider to ascertain whatever information, as specified by the smart light definitions, that is provided by the smart lights 82*a*,82*b*,82*c*.

FIGS. 3 and 4 show an alternative arrangement of a dash panel 80'. As best seen in FIG. 4, the dash panel 80' can be comprised of a fixed portion 80*a* and a relatively transportable palm-size computer 120, which will be described in detail below. The fixed portion 80*a*, which includes the display device 82, the map selection switch 84, and the on/off switch 90, is fixed with respect to the handlebars 200. The palm-size computer 120, which includes a display device, is detachable relative to the handlebars 200. The display device can be a display screen that is integrated the palm-size computer 120. Although the smart lights 82*a*,82*b*, 82*c* are not shown in FIGS. 3 and 4, the fixed portion 80*a* could also include the smart lights 82*a*,82*b*,82*c*. The palm-size computer 120 can be detached and stowed, either on the operator's person, on the vehicle, or elsewhere, when it is no longer necessary for the rider to trim the engine 100, or when the operator wishes to protect the palm-size computer 120 from the ambient conditions (e.g., rain, dust, etc).

Referring now to all of the figures, the functions and relationships of the system components will now be described. As the engine management system 10 is shown in the figures, the engine control unit 20 supplies a first control signal for a first engine control, e.g., fuel quantity, and a second control signal for a second engine control, e.g., ignition timing. Thus, for each map set stored in the engine control unit 20, there is an ignition timing map and a fuel amount map. However, in general, a map set can include different numbers of maps (i.e., only one or more than two), different types of maps (e.g., fuel timing, power jet actuation, or power valve actuation), or different combinations of map types (e.g., ignition timing, fuel timing, and power valve actuation).

Table 1 shows an example of a map that includes an arbitrarily selected number of ignition timing setpoints. Each setpoint corresponds to the values of two engine operating characteristics, i.e., an engine speed value and a throttle position setting value. Thus, for a given value of engine speed (e.g., as sensed by or derived from an output signal from a crankshaft angular motion sensor 102) and for a given value of throttle position setting (e.g., as measured by the throttle position sensor 44), an ignition timing setpoint is assigned. For example, this map tells the engine control unit 20 to deliver an ignition timing of 5 degrees before top dead center (BTDC) at 2000 revolutions per minute (r.p.m.), regardless of throttle opening. At 5000 r.p.m., the engine control unit 20 will vary ignition timing from 25 degrees BTDC, when the throttle is closed, to 30 degrees BTDC, when the throttle is open 75% or more.

TABLE 1

| Ignition Timing | | Engine speed (revolutions per minute) | | | |
|---|---|---|---|---|---|
| (degrees BTDC) | | 0 | 2000 | 5000 | 7000 |
| Throttle | 0 | 0 | 5 | 25 | 14 |
| opening | 25 | 0 | 5 | 27 | 12 |
| (percentage) | 50 | 0 | 5 | 29 | 10 |
| | 75 | 0 | 5 | 30 | 9 |
| | 100 | 0 | 5 | 30 | 7 |

In general, a map will include a great number of setpoints that can be assigned for every conceivable engine performance, as determined by measuring one or more engine operating characteristics. If a map includes gaps between specified values of the characteristics (e.g., in Table 1, there are gaps of 2000 r.p.m. or more between the specified values for engine speed), the engine control unit 20 can interpolate the operating control values between two specified characteristic values.

Engine management data including one or more map sets can be downloaded to the engine control unit 20 from the palm-size computer 120, either via a data port 110 or by "docking" the palm-size computer 120 with the fixed portion 80*a* of the dash panel 80'. The coupling between the palm-size computer 120 and either the data port 110 or the fixed portion 80*a* can be via wires or wireless. In addition to map sets, the engine management data can include the map trim definitions, and the smart light definitions, as well as software updates for the engine control unit 20.

As it is used herein, the expression "palm-size computer" refers to a hand-held device enclosed within a housing that generally fits within a normal size palm of a normal operator's hand. The height, width, and thickness dimensions of a palm-size computer are no larger than approximately 6 inches by approximately 4 inches by approximately 1 inch. Thus, a palm-size computer is readily transportable, e.g., within a normal size shirt pocket.

Palm-size computers, which are battery powered, generally include a touch-screen as an input/output device. Examples of such palm-size computers include Hewlett-Packard's Pocket PC and 3Com's PalmPilot.

The inventors have discovered a number of unexpected results that are achieved by using a palm-size computer 120 that runs a set of engine management tools for communicating engine management data to the engine control system of a motorcycle. For example, these advantages include the relative small cost of the palm-size computer 120 with respect to the cost of a laptop or desktop personal computer. The reduced size, reduced weight, and increased tolerance to mechanical shock (such as may be caused by impacts, bouncing, jarring, etc.) of the palm-size computer 120 relative to laptop or desktop personal computers, are also advantageous. With regard to the latter, the small size, low weight, and increased tolerance to mechanical shock can even make it possible for a motorcycle rider participating in an endurance event to carry the palm-size computer 120 on-board during the event, e.g., in a clothing pocket or in a storage compartment on the motorcycle. The set of engine management tools can include a calibration tool such as OPT Cal software, which is manufactured by Optimum Power Technology. Using OPT Cal software, the engine operator can tell the engine control unit 20 which map set is to be activated, the map trim definitions that designate the active, i.e., modifiable, portions of the map set, and the smart light definitions. The data port 110 used to transfer data between the palm-size computer 120 and the engine control unit 20 can be any configuration (e.g., using a physical connection such as a docking or a cable, using transceiving techniques, etc.) and can use any protocol (e.g., RS-232 or ISO 9141).

In addition to processing downloaded data, the engine control unit 20 can also be connected to any necessary on-board sensor. The air-temperature sensor 46 and barometric pressure sensor 22 can provide sensor signals representing the density of the air being inducted into the engine 100, and can be used to effect global changes to all control signals based on the values in each map set that has been downloaded to the engine control unit 20. In connection with this invention, the expression "global" refers to making an adjustment with respect to every setpoint in a control map, whereas "local" refers to a setpoint or a group of setpoints in a control map. The sensor signals from the engine speed sensor 102 and throttle position sensor 44, in addition to being monitored by the engine control unit 20 for accessing setpoints, can be used to determine which setpoint(s) is to be the basis for trimming. Using the engine management system 10 in connection with the fuel delivery system 40 including fuel injector(s) 42 can be considered to be analogous to carburetor jetting, i.e., below a certain throttle opening, trimming according to the present invention corresponds to changing the slow jet, trimming at higher throttle openings corresponds to changing the needle jet, and trimming at still higher throttle openings corresponds to changing the main jet. However, unlike the trims according to the engine management system 10, most jet changes cannot be done while the engine is operating.

Additionally, a sensor (not shown) for electrical system voltage can measure variations that directly affect the reaction time and accuracy of the electromechanical movements within the fuel injector(s) 42. Sensors (not shown) for gear position and side stand deployment can be used to alert a motorcycle rider to potentially harmful or dangerous conditions. And a sensor (not shown) for detecting the initiation of a gear change can signal the engine control unit 20 to momentarily cut-off the ignition system or the fuel delivery module 40, thereby facilitating smoother shifts. Of course, the engine control unit 20 can be connected to many other sensors, e.g., sensors (not shown) for engine coolant temperature or oil pressure that can provide a warning to the engine operator.

The engine control unit 20 also receives trim signals, trim defeat signals, and map selection signals from the dash panel 80, and activates the smart lights 82*a*,82*b*,82*c* as appropriate, in accordance with the smart light definitions. The trim functions are controlled by the map set selection switch 84, the at least one map trim +/− switch 86, and the map trim defeat switch 88. As it is shown in FIGS. 2–4, the map set selection switch 84 can be a three-position toggle switch, thereby providing a choice of three map sets. Alternatively, the map set selection switch 84 can provide a choice of only two map sets or more than three map sets. The possible permutations of map sets that can be selected is very large. As a first example, the center position of the map set selection switch 84 can be assigned to a map set that optimizes the acceleration of a vehicle from a resting position, the lower position of the map set selector switch 84 can be assigned to the map set that is to be used a majority of the time, and the upper position of the map set selection switch 84 can be used when peak power output is required. As a second example, the lower position of the map set selector switch 84 can be assigned, in accordance with the accompanying map trim definitions, to enable the ignition timing map to be trimmed, and the upper position of the map set selection switch can be assigned, in accordance with the accompanying map trim definitions, to enable the fuel quantity map to be trimmed.

The map trim +/− switch 86 can be a three-position rocker switch for incrementing or decrementing the trim control values based on the currently active setpoint (or group of setpoints including the currently active setpoint) by a specified function or amount. Alternatively, rocking the map trim +/− switch 86 to either of the (+) or (−) can initiate a complex set of adjustments to a group of setpoints including the currently active setpoint. As an example of such a complex adjustment, the adjustments to each of the setpoints in the group can be proportional to the adjustment applied to the currently active setpoint. Also, as discussed above, the adjustments signaled by the map trim +/− switch 86 can be applied to the currently selected map, or can be applied to all like maps. As shown in FIGS. 2–4, separate pushbuttons 86*a*,86*b* can be substituted for the three-position rocker-type map trim +/− rocker switch 86.

The map trim defeat switch 88 allows the engine operator to perform instant comparisons, i.e., "ABAB," between the base map set and the trimmed map set. Moreover, these comparisons can be performed while the engine is being continuously operated in its intended environment. The map trim defeat switch 88 also signals the engine control unit 20 whether or not to process inputs from the map trim +/− switch 86.

As shown in FIG. 2, the display device 82 can comprise a set of three smart lights 82*a*,82*b*,82*c* that assist the engine operator in the trimming process. The smart lights 82*a*,82*b*, 82*c* can be set-up in accordance with the active smart light definitions to convey different information. For example, the smart lights 82*a*,82*b*,82*c* can indicate if the engine is currently performing in a part of the map that the trims are active, or whether an attempt has been made to trim above or below safe maximum or minimum values that are predetermined by the engine operator. The smart lights 82*a*, 82*b*,82*c* can also be defined to alert the engine operator to such conditions as a sensor failure, low battery voltage, or engine overheating. In addition to having different modes of operation (i.e., dark, continuously glowing, slow flashing, and rapid flashing), the smart lights 82*a*,82*b*,82*c* can have different colors (e.g., green, amber, and red) to further increase the amount of information that can be ascertained with only a glance by the operator.

Figure 5:
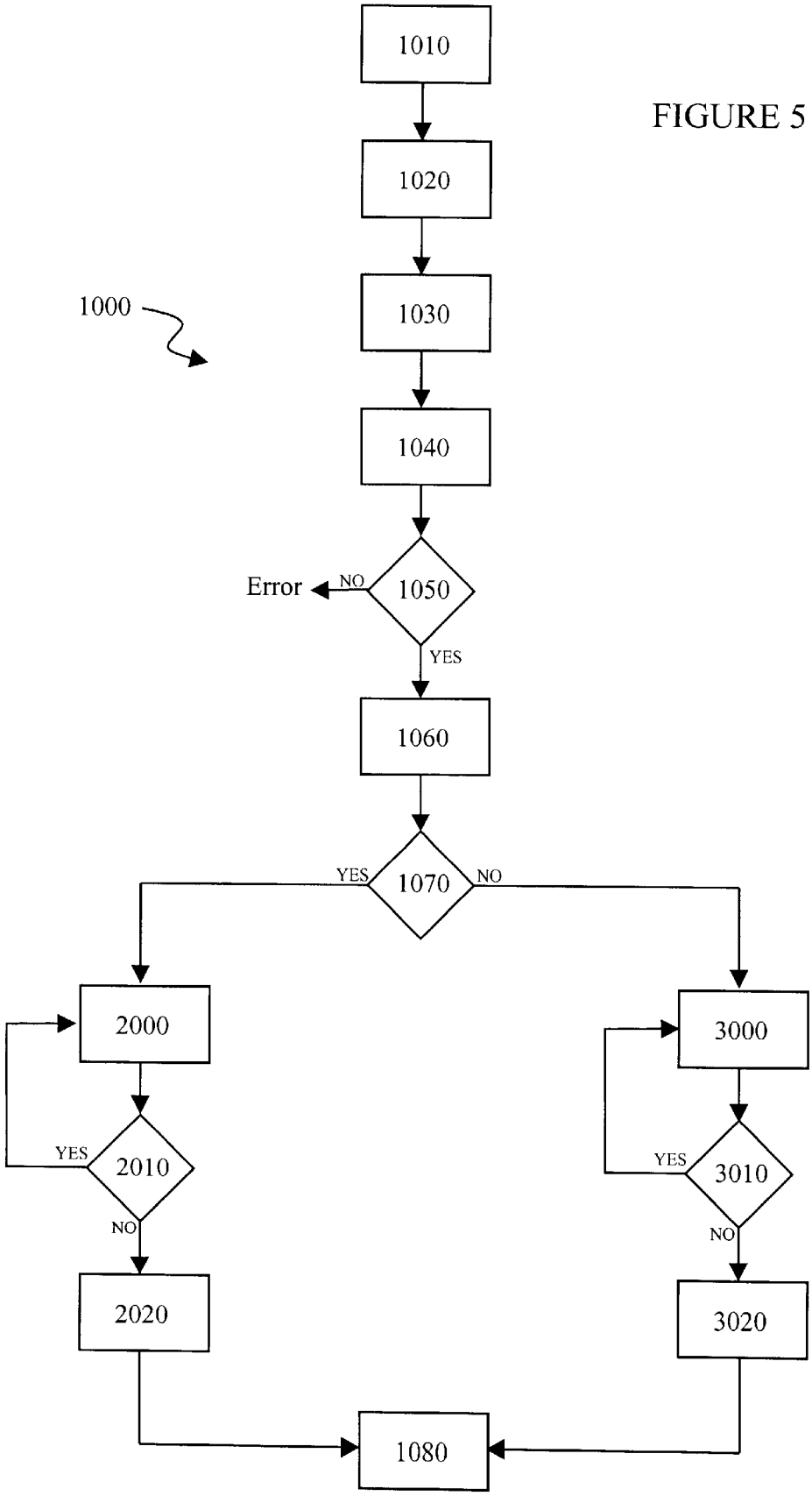
FIG. 5 is a flow chart illustrating a method of calibrating engine performance in accordance with an embodiment of an engine management tool for calibrating engine operation.

FIG. 5 illustrates an example of a method 1000 for using the engine management system 10 to trim the idle performance of the engine 100 with the object of calibrating a fuel delivery map to obtain optimal idle speed performance. In step 1010, the map trim defeat switch 88 is configured to activate the map trim +/− switches 86*a*,86*b*. In step 1020, the engine management system 10 is set-up. The set-up 1020 can include: 1) establishing map trim definitions to designate small throttle settings (e.g., 0–10% throttle opening) as the active range, and to limit trim capability (e.g., no more than +/− 20% of setpoint value in the base control map), 2) establishing smart light definitions so that light 82*c* glows steadily if the throttle position sensor 44 supplies a sensor signal indicating that the engine 100 is performing in the active range, and 3) downloading to the engine control unit 20 (e.g., via the data port 110) a map set, the map trim definitions, and the smart light definitions. In step 1030, the engine 100 is started. In step 1040, the operator releases throttle so as to allow the engine 100 to idle. In step 1050, the engine control unit 20 decides, based on the sensor signal supplied from the throttle position sensor 44, if the engine state is within the active range according to the map trim definitions. If the decision in step 1050 is negative (i.e., "no"), the engine control unit 20 does not supply the display 82 with an information signal to turn-on smart light 82*c*. If the decision in step 1050 is positive (i.e., "yes"), the engine control unit 20 supplies to the display 82 an information signal to turn-on smart light 82*c*, thereby providing an indication to the operator that manipulating the trim +/− switches 86*a*,86*b* and the trim defeat switch 88 are effective to calibrate the engine 100. In step 1060, after a positive decision in step 1050, the operator presses the trim + pushbutton 86*a*. In step 1070, the operator, with or without assistance from the display 82, decides if the engine performance has varied such that the engine 100 is rotating faster (i.e., an increase in r.p.m.).

In step 2000, after a positive decision in step 1070, the operator again presses the trim + switch 86*a*. In step 2010, the operator again decides if the engine performance has varied such that the engine 100 is rotating faster (i.e., an increase in r.p.m.). If the decision in step 2010 is positive, step 2000 is repeated. Step 2000 is repeated until either the trim capability limit (e.g., a trim signal adding 20% to the base engine control value of the setpoint value according to the base control map) is reached (not shown), or the operator decides that the engine performance has varied such that the engine 100 is rotating slower (i.e., a decrease in r.p.m.). If the decision in step 2010 is negative, the operator presses the trim − pushbutton 86*b* to return to the previous engine performance.

In step 3000, after a negative decision in step 1070, the operator presses the trim — pushbutton 86*b*. In step 3010, the operator again decides if the engine performance has varied such that the engine 100 is rotating faster (i.e., an increase in r.p.m.). If the decision in step 3010 is positive, step 3000 is repeated until either the trim capability limit (e.g., a trim signal subtracting 20% from the base engine control value of the setpoint value according to the base control map) is reached (not shown), or the operator decides that the engine performance has varied such that the engine 100 is rotating slower (i.e., a decrease in r.p.m.). If the decision in step 3010 is negative, the operator presses the trim + pushbutton 86*a* to return to the previous engine performance.

In step 1080, the operator has successfully optimized the idle speed performance of the engine 100, i.e., within the active range according to the map trim definitions.

The map trim defeat switch 88 can be operated to perform an ABAB comparisons to evaluate the effect of trimming the engine 100 as compared to the base control map. The compilation of the trim control values selected by the operator are stored in the trim control map set and can be uploaded to the personal computer for modifying the base map set, thereby creating a fresh base map that can be used subsequently.

Thus, the engine management system 10 provides many advantages including calibrating engine performance with adjustments that can be made while the engine 100 is being operated in its intended environment, and enabling an ABAB comparison during this operation to evaluate the effectiveness of the adjustments. An "ABAB" comparison refers to the operator alternately manipulating the trim defeat switch 88 between its first and second configurations. In the first configuration of the trim defeat switch 88, a trim defeat signal causes the engine control unit 20 to calculate the engine operating control values equal to the base engine control values modify by the trim control values (i.e., with the trim control map modifying the base control map). In the second configuration of the trim defeat switch 88, the trim defeat signal causes the engine control unit 20 to calculate the engine operating control values equal solely to the base engine control values (i.e., without the trim control map modifying the base control map).

Additionally, embodiments of the engine management system 10 can be provided as a kit such that the engine control unit 20 and an ignition module can replace an existing ignition system, and the fuel delivery system 40 and fuel pump 50 can replace an existing carburetor. The kit can additionally include a replacement wiring loom (not shown) to be substituted for the existing wiring loom. Another advantage of the engine management system 10 is that its functions are universally applicable, i.e., the engine management system 10 is not vehicle model specific, and all the main components can be transferred between different vehicles with only an additional loom or a software upgrade to the engine control unit 20 possibly required for the second vehicle.

The embodiments of the engine management system 10 can be provided for internal combustion engine powered land traversing vehicles, watercraft, and flying vehicles, and thus include motorcycles, all-terrain vehicles, snowmobiles, boats, personal watercraft, and airplanes.

The embodiments described above are examples of the present apparatus and method for trimming an engine management system whereby a number of advantages are achieved.

These advantages include allowing engine operation to be calibrated during continuous operation in the engine's intended environment. For example, the performance of a race engine can be calibrated during a race, without stopping the engine and without coming into the pits. Moreover, engine performance can be modified within particular user defined ranges of engine performance.

These advantages also include allowing map set(s) to be provided to the engine control unit 20 as downloads from the palm-size computer 120. These map sets can be provided to the external processor via any known data transfer technique or protocol, including via the world wide web or by computer diskette.

These advantages further include providing trim controls on the dash panel 80,80' that are readily accessible to the engine operator in the course of continuously operating the engine 100 in its intended environment. For example, the dash panel 80,80' can comprise at least one switch mounted so as to be readily actuatable by a finger of a hand grasping the left-hand grip 202 of motorcycle handlebars 200. The trim control switches can be ergonomically positioned on the dash panel 80,80' to facilitate tactile identification and operation of the controls by a rider wearing gloves.

These advantages yet further include providing one or more display devices 82 on the dash panel 80,80' that are capable of conveying information with only a brief glance by the engine operator. These display devices 82 can include a plurality of "smart," i.e., definable operation, lights 82*a*, 82*b*,82*c* that can use different modes (e.g., off, steady glow, slow flashing, rapid flashing, etc.) to present different types of information (e.g., engine status, engine control unit status, trim conditions, etc.). The definitions for operating these smart lights 82*a*,82*b*,82*c* can be downloaded to the engine control unit 20 at the same time as the map set(s) are downloaded to the engine control unit 20.

While the present invention has been disclosed with reference to certain embodiments, numerous modifications, alterations, and changes to the described embodiments are possible without departing from the sphere and scope of the present invention, as defined in the appended claims. Accordingly, it is intended that the present invention not be limited to the described embodiments, but that it have the full scope defined by the language of the following claims, and equivalents thereof.

What is claimed is:

1. A method of tuning an engine, comprising:

storing a map on an external computer;

coupling the external computer to a palm-size computer;

downloading the map from the external computer to the palm-size computer;

mounting the palm-size computer on a motorcycle;

coupling the palm-size computer to an engine control unit; and downloading the map from the palm-size computer to the engine control unit;

wherein the engine control unit determines an engine operating value utilizing the map.

2. An engine management system, comprising:

an engine control system determining an engine operating control value, the engine operating control value being supplied to an engine to control an aspect of engine operation;

a palm-size computer communicating engine management data to the engine control system; and an external computer communicating engine management data to the palm-size computer, wherein the palm-size computer may be coupled to the engine control system and coupled to the external computer independently.

3. An engine management system for an internal combustion engine, the engine management system comprising:

an engine control system calculating an engine operating control value, the engine operating control value being adapted to be supplied to the internal combustion engine to vary engine performance;

a palm-size computer transportable relative to the engine control system, the palm-size computer having height, width, and thickness dimensions no larger than approximately 6 inches by approximately 4 inches by approximately 1 inch, and the palm-size computer running a set of engine management tools for communicating engine management data to the engine control system; and an external computer communicating with the palm-size computer, the external computer downloading to the palm-size computer engine management tools and engine management files and uploading from the palm-size computer engine management files.

4. The engine management system according to claim 1, wherein the palm-size computer comprises a touch-screen and a battery.

5. The engine management system according to claim 1, wherein the palm-size computer comprises a file sub-system.

6. The engine management system according to claim 1, wherein the palm-size computer comprises a touch-screen, a battery, and a file sub-system.

7. The engine management system according to claim 1, wherein the external computer communicating with the palm-size computer via at least one of a wire, a docking station, and electromagnetic waves.

8. The engine management system according to claim 1, wherein the palm-size computer comprises a communication sub-system communicating with the external computer via one of a local area network and a world-wide web.

9. The engine management system according to claim 8, wherein the communication sub-system includes an internet browser.

10. The engine management system according to claim 1, wherein the engine management files comprise a base engine control map, the base engine control map correlating values of an engine performance characteristic with values of a base engine control.

11. The engine management system according to claim 10, wherein the engine management data comprises a trim control map separate from the base engine control map, the trim control map correlating the values of the engine performance characteristic with values of a trim control.

12. The engine management system according to claim 10, wherein the set of engine management tools comprises a calibration tool that can define all base engine control values in a base engine control map, adjust base engine control values in a base engine control map, communicate a base engine control value to the engine control system, and communicate a base engine control map to the engine control system.

13. An engine management system, comprising:

an internal combustion engine;

an actuator mounted adjacent said engine to control an aspect of engine operation;

an engine control system having a memory and an output, wherein said memory has stored therein instructions for determining an engine operating control value and having an output on which a signal commensurate with said control value is incident, said output being coupled to said actuator;

a palm-size computer communicating engine management data used in determining the engine operating control value to the engine control system;

a first coupler coupling said palm-size computer to said engine control system;

an external computer communicating said engine management data to said palm-size computer, wherein said palm-size computer may be coupled to said engine control system and coupled to said external computer independently; and a second coupler coupling said palm-size computer to said external computer.

14. The engine management system of claim 13, wherein said actuator controls ignition timing.

15. The engine management system of claim 13, wherein said actuator controls fuel delivery.

16. The engine management system of claim 13, wherein said engine management data is a map.

17. The engine management system of claim 13, wherein said first coupler is a cable.

18. The engine management system of claim 13, wherein said first coupler is a wireless communication device.

19. The engine management system of claim 13, wherein said second coupler is a cable.

20. The engine management system of claim 13, wherein said second coupler is a wireless communication device.

* * * * *

UNITED STATES PATENT AND TRADEMARK OFFICE

CERTIFICATE OF CORRECTION

PATENT NO. : 6,512,974 B2 
DATED : January 28, 2003
INVENTOR(S) : Roy D. Houston and Glen F. Chatfield It is certified that error appears in the above-identified patent and that said Letters Patent is hereby corrected as shown below:

Column 13,
Lines 3, 6, 9, 12, 16 and 23, please replace "claim 1" with -- claim 3 --.

Signed and Sealed this

Second Day of September, 2003

JAMES E. ROGAN
*Director of the United States Patent and Trademark Office*